US006969037B2

(12) United States Patent
Eby et al.

(10) Patent No.: US 6,969,037 B2
(45) Date of Patent: Nov. 29, 2005

(54) DISPLAY PLATFORM

(75) Inventors: David C. Eby, Madison, WI (US); Gilius A. Gaska, Madison, WI (US); Aaron W. Smith, Plainfield, IL (US)

(73) Assignee: Rubbermaid Incorporated, Wooster, OH (US)

( * ) Notice: Subject to any disclaimer, the term of this patent is extended or adjusted under 35 U.S.C. 154(b) by 62 days.

(21) Appl. No.: 10/464,137

(22) Filed: Jun. 18, 2003

(65) Prior Publication Data

US 2004/0256533 A1 Dec. 23, 2004

(51) Int. Cl.[7] ..... A47B 97/04
(52) U.S. Cl. ..... 248/460; 248/444; 248/459
(58) Field of Search ..... 248/444, 441.1, 248/473, 469, 127, 188, 456, 4; 40/650, 651, 606.12; 403/375, 345, 381, 282

(56) References Cited

U.S. PATENT DOCUMENTS 2,313,559 A * 3/1943 Larsen et al. ..... 297/303.1
2,520,490 A * 8/1950 Nellic ..... 273/150
2,628,051 A * 2/1953 Irwin ..... 248/231.71
3,547,491 A * 12/1970 Bovasso ..... 297/440.13
4,140,065 A * 2/1979 Chacon ..... 108/156
4,225,180 A * 9/1980 Gillis ..... 297/271.5
4,593,950 A * 6/1986 Infanti ..... 297/3
4,887,812 A * 12/1989 Moormann ..... 473/487
6,619,749 B2 * 9/2003 Willy ..... 297/440.13

* cited by examiner

*Primary Examiner*—Leslie A. Braun
*Assistant Examiner*—A. Joseph Wujciak
(74) *Attorney, Agent, or Firm*—Marshall, Gerstein & Borun LLP

(57) ABSTRACT

A desktop organizer including a curvilinear support having an integral locking groove including at least one retaining slot and an attachment means formed contiguous to the support and aligned with the at least one retaining slot is disclosed. The desktop organizer further includes a flexible back deformable into an arc having geometry complimentary to the curvilinear support and at least one retaining tab formed integrally on an edge adjacent to the locking groove, wherein the at least one retaining tab is aligned with the at least one retaining slot. The retaining tab is formed to have an attachment slot aligned with the attachment means. The desktop organizer includes at least one support leg having a base and an arcuate portion, wherein the arcuate portion has a fixed end and a moveable end. The support leg further includes an attachment member arranged on the moveable end distal to the fixed and, the attachment end arranged to engage the attachment means through the attachment slot.

20 Claims, 4 Drawing Sheets

DISPLAY PLATFORM

TECHNICAL FIELD

The display platform disclosed herein relates generally to desktop organizers and supports for reading materials. In particular, the display platform is configured for the support and display of materials within the active zone of the desktop workspace.

BACKGROUND

The desks and workspace of office workers are often cluttered with papers, periodicals, notes and other assorted office paraphernalia making organization and efficiency difficult, if not impossible. It is well known to provide a desktop support for books or magazine reading including a mechanism for holding pages open without the need for constant attention from the reader.

An exemplary embodiment of such a known desktop support is disclosed by Portis Jr., et al. in U.S. Pat. No. 4,378,102 and entitled "Book or Magazine Reading Support." The disclosed organizer includes V-shaped brackets having a long-arm and a short-arm, each arm including a slot. The slots configured to engage a corresponding pair of slots in a back board such that a ledge, arranged perpendicular to the plane of the back board, is arranged to support reading material. The V-shaped brackets may be arranged in a low mode position by engaging the slot of the short arms with the slots on the back board, or a high mode position by engaging the slots in the long arms. The apex of the V-shaped brackets constructed in the manner disclosed occupies the desk area adjacent to the user which, in turn, limits the workspace available on the desktop.

Known desktop organizers typically include a flat, planar back board positioned at an acute angle, relative to the surface of the desktop, to facilitate easy review of the supported documents. Generally, known organizers, as discussed above, do not provide for any additional storage or note holding area or otherwise increase the organization or the available workspace. In fact, known organizers or reading supports are typically centered on the surface of the desk or workspace when in use, thereby limiting the amount of available workspace.

BRIEF DESCRIPTION OF THE DRAWINGS

The figures described herein are intended to be illustrative and not limiting of an exemplary embodiment of a display platform in which.

DETAILED DESCRIPTION

Figure 1:
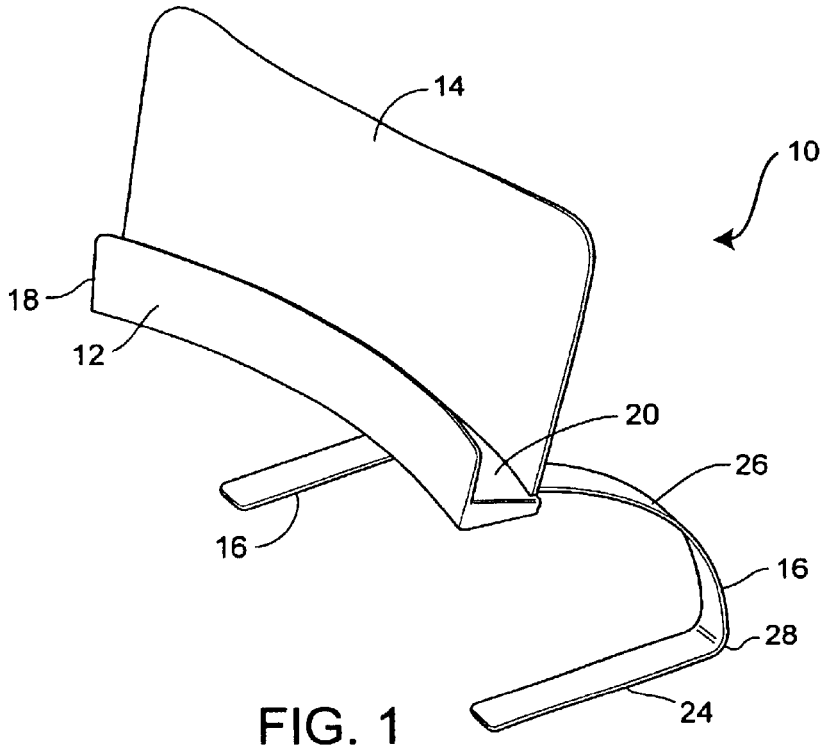
FIG. 1 illustrates an isometric view of an embodiment of the display platform.

FIG. 1 illustrates an exemplary embodiment of a display platform 10. The display platform 10 is configured for use within an active zone of a desk or workspace. The active zone is generally defined as a portion of the desktop or workspace in which work is actually being conducted, as opposed to space used for storage, or filing of materials. The display platform 10 disclosed herein may be positioned within the center of the active zone without reducing the available workspace and simultaneously provide for organizing loose papers and notes to remove desktop clutter.

The display platform 10 further includes a support tray 12, a flexible back panel 14 and a plurality of support legs 16. The support tray 12 has a note surface 18, a working surface 20 and a support surface 22, illustrated in FIG. 2. Each of the plurality of support legs 16 includes a base portion 24 and a bowed or arcuate portion 26 flexibly joined at a flexible joint 28.

Figure 2:
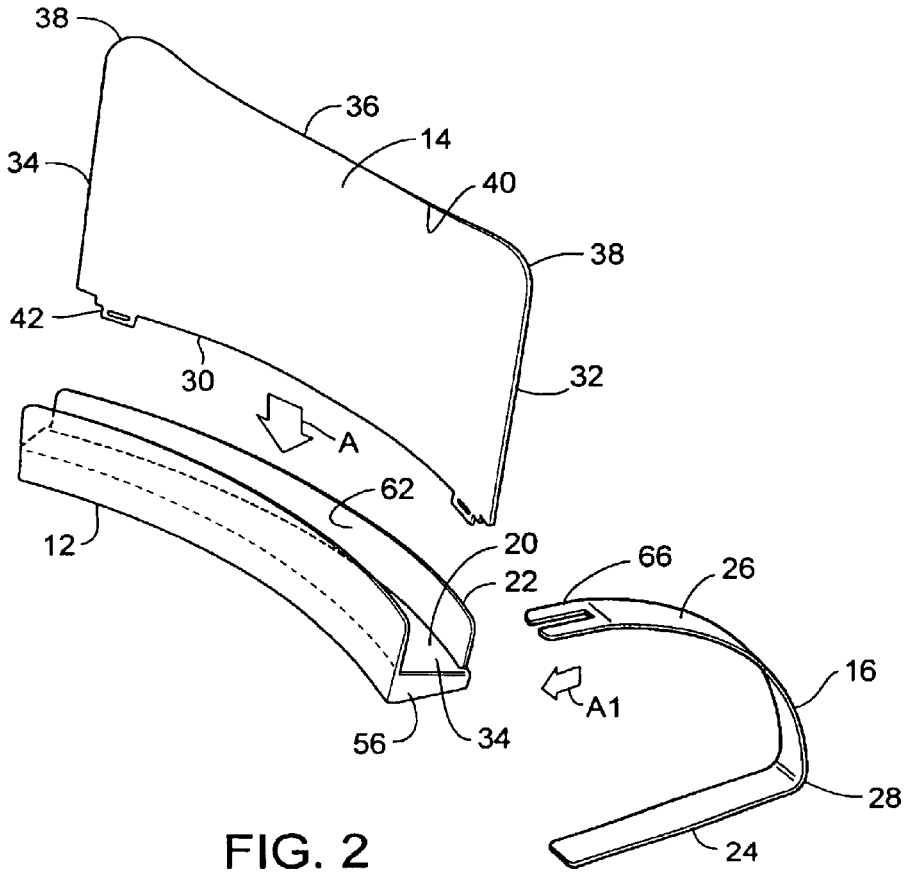
FIG. 2 illustrates an exploded isometric view of the components of the display platform of FIG. 1.

FIG. 2 illustrates an exploded view of the display platform 10 shown in FIG. 1. The back panel 14 is shown in a flexed or curved position, as opposed to the relaxed or flat position illustrated in FIG. 3. The back panel 14 has a bottom edge 30, a first side 32, a second side 34 and a curved top 36. The curved top 36 is formed by filleting or rounding the corners between the curved top 36 and the first and second sides 32, 34 as indicated by the numeral 38. The curved top 36 smoothly joins the filleted corners 38 via a continuous line 40. The continuous line 40 may be defined by the relationship between D, the overall side dimension, and d, the reduced side dimension. In the embodiment illustrated in FIG. 3, the relationship is approximately 1 to 1.13. It will be understood by a person of ordinary skill in the art that this relationship may be varied to suit the aesthetic or functional needs of the end user, without departing from the spirit of scope of the disclosed display platform 10.

Figure 3:
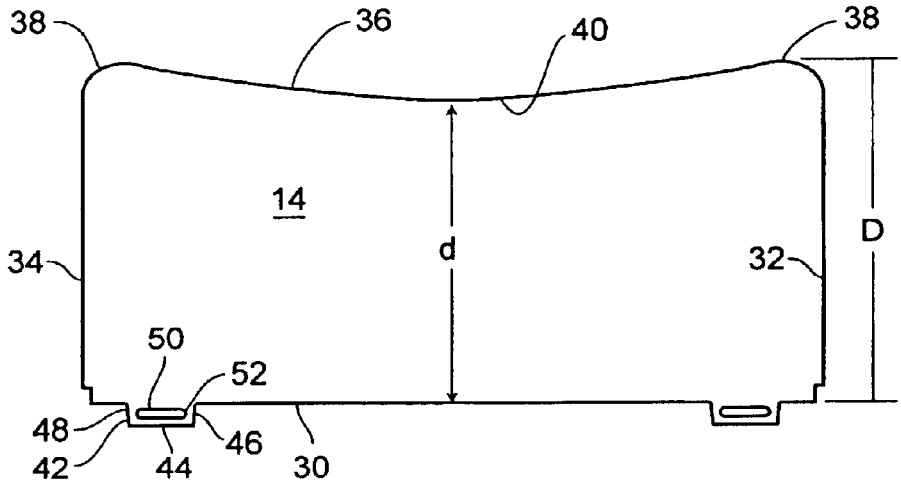
FIG. 3 illustrates a detail view of a back panel shown in FIG. 2.

The back panel 14, illustrated in the flat position in FIG. 3, includes at least one tab 42 extending from the bottom edge 30. In the depicted embodiment two tabs 42 are provided, but it is to be understood that more or less tabs can be used within the scope of this disclosure. The tab 42 having a roughly rectangular shape and includes a bottom 44, a pair of sides 46, 48 and a slot 50. The slot 50 may have a pair of rounded ends 52, as illustrated in FIG. 3, or may define a regular or rectangular shape. It will be understood that the physical layout of the back panel 14 is likely to result, in part, from the method of manufacturing used to produce the component. If, for example, the back panel 14 is manufactured from a polyethylene sheet and then punched into a final shape using a custom punch and die, it is understood that all of the component's corners are likely to have radiuses or fillets, because rounded corners facilitate the wear and release characteristics of the tooling and the final product from the die.

The support tray 12 cooperates with the note surface 18, the working surface 20 and the support surface 22 to define a channel 54 having a roughly U-shaped cross-section. The working surface 20, in the assembled position shown in FIG. 1, defines a plane oriented substantially parallel to the desktop surface. The note surface 18 provides a substantially vertical surface, relative to the plane and the desktop, for affixing self-adhesive notes such as Post-it® brand notes or other paperwork, such as phone numbers. The note surface 18 extends below the plane and cooperates with a transition surface 56 to form a cosmetic skirt which may improve the appearance of the display platform 10, provide additional note surface and hide an attachment mechanism 58, shown in FIGS. 4, 6 and 7.

Figure 4:
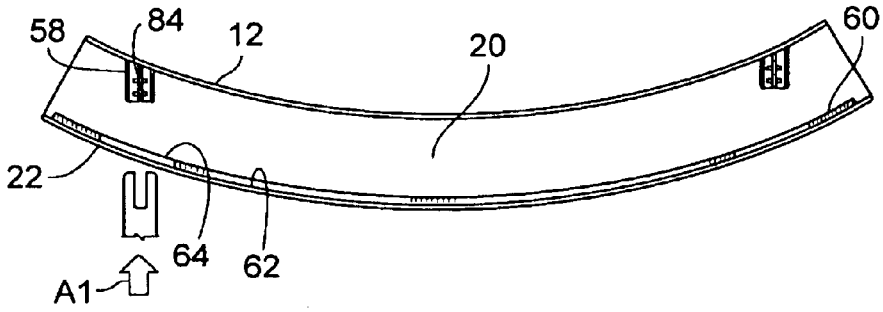
FIG. 4 illustrates a top view of a support tray shown in FIG. 2.
Figure 6:
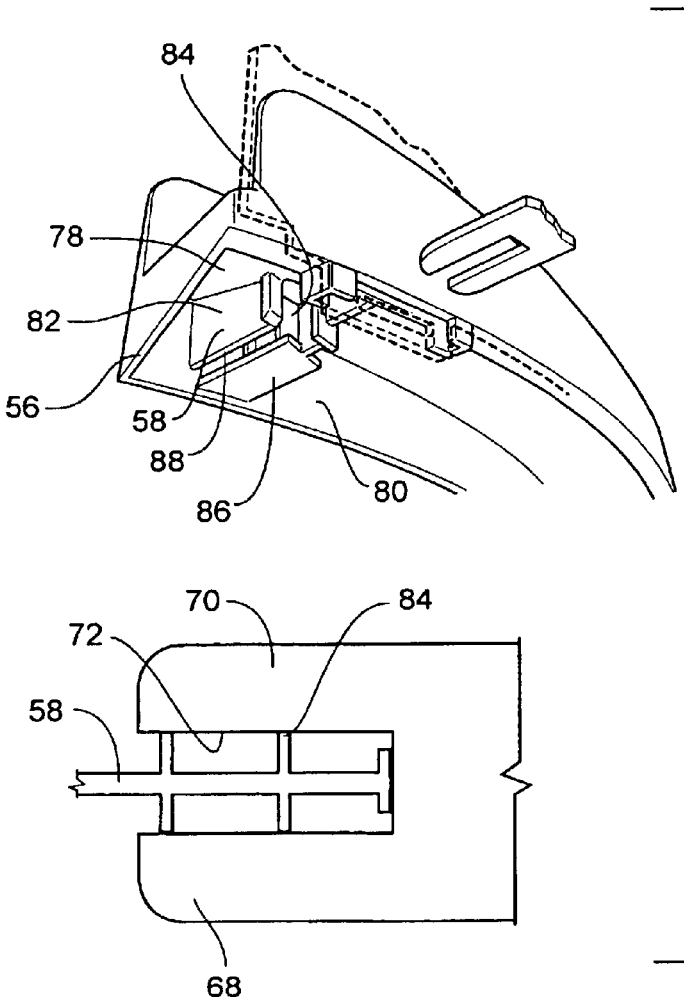
FIG. 6 illustrates an enlarged isometric view of the attachment mechanism shown in FIG. 4.
Figure 7:
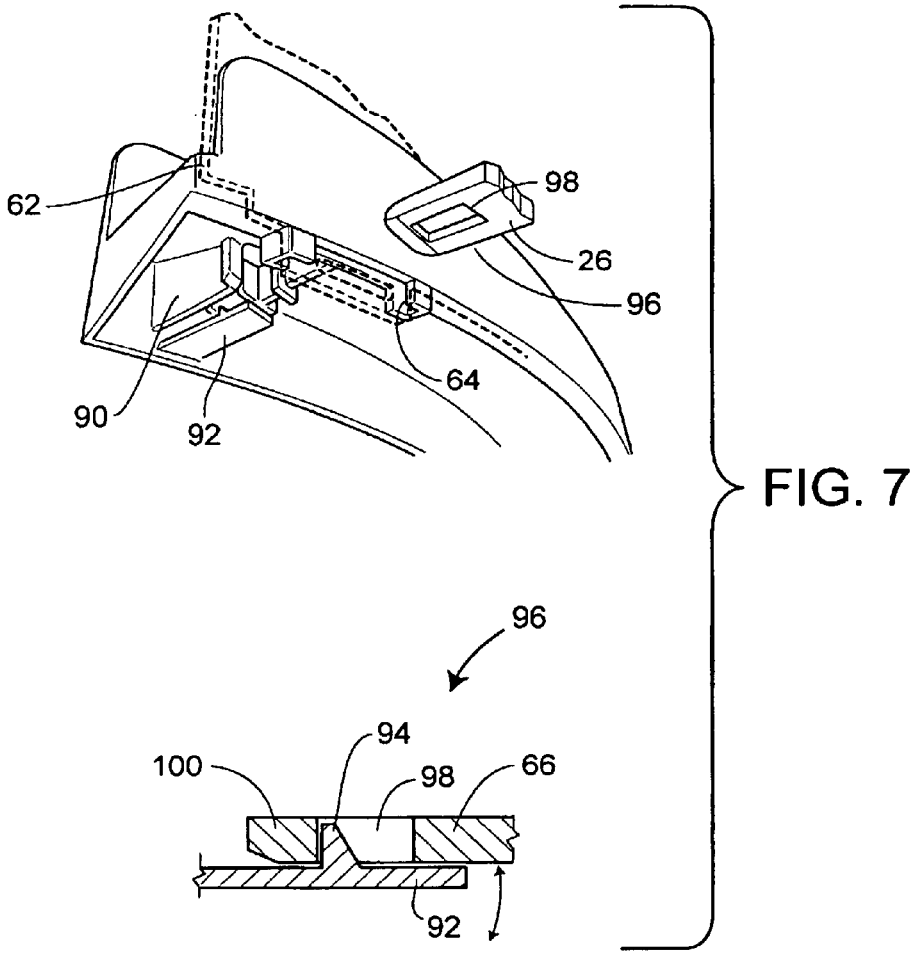
FIG. 7 illustrates an enlarged isometric view of an alternate attachment mechanism shown in FIG. 4.

The support surface 22 extends substantially vertical relative to the plane and the desktop, and substantially parallel to the note surface 18. To increase strength and rigidity of the support surface 22 a portion may be extended below the plane defined by the working surface 20 and be integrally affixed to the skirt 56. A receiving groove 60 (see FIG. 4) may be formed within the working surface 20 and adjacent to an interior surface 62 of the support surface 22. The receiving groove 60 may be sized to slideably accept the back panel 14, when the back panel is deformed into the curved or flexed position, as shown in FIG. 1. FIG. 4, a top view of the support try 12, clearly illustrates that the receiving groove 60 includes a receiving slot 64 sized to accept the tab 42, when the back plane 14 is inserted into the receiving groove, in the direction indicated by the arrow A and as shown in FIG. 1. FIGS. 6 and 7 provide an alternate view of the back panel 14 and tab 42 (both identified with dashed lines) cooperating with the receiving groove 60 and the receiving slot 66.

Figure 5:
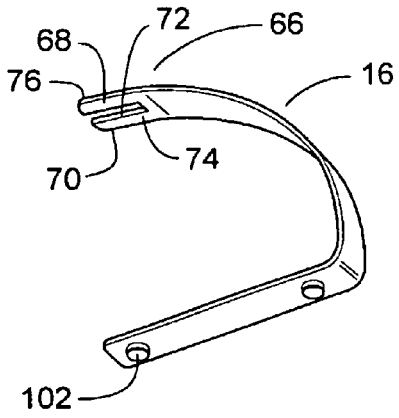
FIG. 5 illustrates a support leg shown in FIG. 2.

The support leg 16 is flexibly joined at the flexible joint 28 to define the base portion 24 and the bowed or arcuate portion 26. The base portion and the arcuate portion cooperate to provide a resilient stand for cantilevering the support tray 12 over the active zone (and the base portion 24) and thus enable the active zone to be continually used. The support legs 16 may be manufactured from strip stock steel such as HR P&O 1010/1020 or any other suitably strong and resilient material. The support legs 16 may further be manufactured to include an attachment member 66 and a support pad 102 on a bottom surface 104 of the base 24, the details of which are clearly viewed in FIG. 5. The attachment member 66 may be formed to include a pair of parallel prongs 68 and 70. The prongs 68 and 70 cooperate to define a substantially rectangular shaped opening having an interior edge 72, a lower surface 74 and an upper surface 76. The rectangular opening and the prongs 68 and 70 can be arranged to cooperate with the attachment mechanism 58 to form a friction or interference fit, discussed below in detail, between the support leg 16 and the support try 12.

In operation, the back panel 14 is incurvated to a geometric configuration compatible with the receiving groove 60. The curved back panel 14 may then be aligned and inserted into the receiving groove 60, such that the tab 42 is received by the receiving slot 64. The tab 42, when completely inserted into the receiving groove 60 and slot 64, extends below the skirt 56 such that the slot 50 is in vertical alignment with the attachment mechanism 58, as shown in FIG. 6.

As will be clear from FIG. 6, the attachment mechanism 58 is affixed to the undersurface 78 of the working surface 20 and an inner surface 80 of the note surface 18. The attachment mechanism 58 may be molded in place, between the two interior surfaces 78 and 80, during an injection molding process, to provide structural integrity and support to the design. The attachment mechanism 58 includes a pair of external walls 82, the second external wall is not shown in FIG. 6, having a friction surface 88 distal to the undersurface 78 and orthogonal to the inner surface 80. The attachment mechanism 58 further includes a plurality of cross members 84 sized to frictionally engage the prongs 68 and 70 defining the substantially rectangular shaped opening. The cross members 84 are arranged between the pair of external walls 82 and affixed to the undersurface 78 and inner surface 80 for structural integrity, see generally FIGS. 4, 6, and 7. A rigid base 86 can be affixed below the cross members 84, and parallel to the undersurface 78, to complete the partial enclosure of the attachment mechanism 58.

In operation, the support leg 16 can be inserted through the slot 50, as shown in FIGS. 2 and 4 by the arrow A1, and into a gap between the external walls 82 and the rigid base 86. More specifically, the prongs 68 and 70 of the attachment member 66 may be forced into contact with the attachment mechanism 58 by a force applied in the direction of arrow A1. As the prongs 68 and 70 come into contact with the attachment mechanism 58, the lower surface 74 and the upper surface 76 come into frictional contact with an upper surface (not shown) of the rigid base 86 and the friction surface 88 of the external walls 82, respectively. At or about the same time, the interior edge 72 frictionally engages the cross members 84. Upon complete insertion of the attachment member 66 is retained, primarily by frictional contact, within the attachment mechanism.

The exemplary display platform 10, illustrated in FIG. 1, depicts the support tray 14 and the incurvated back panel 12 assembled and cantilevered over the support leg base 24 by the cooperation of the attachment mechanism 58 and the attachment member 66 integrally formed on the arcuate portion 26 of support leg 16. In this manner, the support tray 14, back panel 12 and organized paperwork are suspended above the active zone to provide additional organizational capacity without sacrificing useable desktop workspace.

FIG. 7 illustrates an alternate embodiment of the attachment mechanism 58, identified by the numeral 90. The attachment mechanism 90 is formed and affixed to the undersurface 78 and the inner surface 80, typically via an injection molding process. The attachment mechanism 90 includes a pair of external walls 82 having friction surfaces 88, as discussed above, bracketing the plurality of cross members 84. The attachment mechanism 90 further includes a semi-rigid base 92 having projecting tab 94 located on an upper or interior surface (i.e. on a surface adjacent to the cross members 84).

In operation, the attachment member 96, having a receiving slot 98 formed on the arcuate portion 26 of the support leg 16, can be inserted through the slot 50 in the direction indicated by the arrow A1 of FIGS. 2 and 4. As the attachment member 96 is inserted, a leading edge 100 engages the projecting tab 94, thereby forcing the semi-rigid base 92 to deflect downward (i.e. away from the undersurface 78). The semi-rigid base 92 returns to the undeflected position when the projecting tab 94 is received by the receiving slot 98. Upon return of the semi-rigid base 92 to the undeflected position, the attachment member 96 is retained within the attachment mechanism 90 by the contact between the projecting tab 94 and the receiving slot 98 and some amount of frictional contact.

While the display platform 10 has been described with reference to specific examples, these examples are intended to be illustrative only and not limiting in any way. It will be apparent to those of ordinary skill in the art that changes, modification or deletions may be made to the disclosed embodiments without departing from the spirit and scope of the disclosed device.

What is claimed is:

1. A desktop organizer, comprising:

a curvilinear support having an receiving groove, wherein the locking groove includes at least one receiving slot, the curvilinear support further including an attachment means formed contiguous to the support and aligned with the at least one receiving slot;

a flexible back deformable into an arc having geometry complimentary to the curvilinear support, at least one receiving tab formed integrally on an edge of the back, the edge is adjacent to the locking groove, wherein the at least one receiving tab is aligned with the at least one receiving slot, an attachment slot formed through the at least one receiving tab and aligned with the attachment means;

at least one support leg including a base and an arcuate portion, wherein the arcuate portion has a fixed end and a moveable end, and an attachment member arranged on the moveable end distal to the fixed end, the attachment member arranged to engage the attachment means through the attachment slot.

2. The desktop organizer of claim 1, wherein the curvilinear support further comprises:

a support base having a front and back edges, the back edge adjacent to the receiving groove;

a note surface extending contiguously away from the front edge, and a support surface extending contiguously away from the back edge, wherein the support base, the note surface and the support surface cooperate to form a substantially U-shaped channel.

3. The desktop organizer of claim 2, wherein the curvilinear support is injection modeled from an ABS (acrylonitrile butadiene styrene) material.

4. The desktop organizer of claim 1, wherein the attachment means is a friction lock for engaging a pair of internal surfaces of a fork-shaped end of the attachment member.

5. The desktop organizer of claim 1, wherein the attachment means includes a flexible arm having a receiving ridge sized to engage a retaining aperture formed on the moveable end.

6. The desktop organizer of claim 1, wherein the flexible back is formed from a translucent polyethylene material.

7. The desktop organizer of claim 1, wherein the base includes a cushion fixedly attached to a bottom surface.

8. The desktop organizer of claim 1, wherein the curvilinear support and the flexible back, when assembled, cooperate with the arcuate portion to form a cantilevered stand positioned above the base.

9. A desktop organizer, the desktop organizer including a flexible back member, a curvilinear support having a bottom surface, a note surface and a support surface, and at least one flexible support leg having an arcuate portion and a base portion, the desktop organizer comprising:

an attachment means fixedly attached to the bottom surface;

a groove adjacent to the support surface and having a slot extending therethrough;

an edge of the flexible back member including a receiving tab position within the groove such that the receiving tab is slideable relative to the slot; and an attachment member integrally formed at an end of the arcuate portion and distal to the base portion; wherein the attachment member is received by a receiving slot formed into the receiving tab and slideably engages the attachment means.

10. The desktop organizer of claim 9, wherein the attachment means provides for a friction fit between an external surface of the attachment means and an internal surface of the attachment member.

11. The desktop organizer of claim 10, wherein the attachment member is bifurcated into a first and second finger.

12. The desktop organizer of claim 9, wherein the attachment means includes a flexible snap pivotable between an at-rest position and an engagement position.

13. The desktop organizer of claim 12, wherein the attachment member includes a receiving portion sized to accept the flexible snap.

14. The desktop organizer of claim 13, wherein the attachment member is slideable relative to the flexible snap in the engagement position and fixed secured relative to the flexible snap in the at-rest position.

15. The desktop organizer of claim 9, wherein the attachment means is injection modeled from an ABS (acrylonitrile butadiene styrene) material.

16. A method of manufacturing a desktop organizer, the desktop organizer including a flexible back member, a curvilinear support, and at least one flexible support leg, the assembly method comprising:

providing the flexible back member with at least one receiving tab, the flexible back member being deformable into a curvilinear arc;

providing a curvilinear support having a receiving groove sized to accept the curvilinear arc and including at least one guide slot sized to accept the at least one receiving tab; and providing an attachment member engageable by a corresponding portion of the at least one flexible support leg.

17. The method of manufacturing the desktop organizer of claim 16, wherein the at least one flexible support leg includes an arcuate portion having a moveable end and a fixed end.

18. The method of manufacturing the desktop organizer of claim 17, wherein the moveable end of the arcuate portion includes the receiving end.

19. The method of manufacturing the desktop organizer of claim 17, wherein the fixed end of the arcuate portion is contiguously joined to a base portion.

20. The method of manufacturing the desktop organizer of claim 18, wherein the base portion includes at least one gripping member.

* * * * *